US008181287B2

(12) United States Patent
Luxton

(10) Patent No.: US 8,181,287 B2
(45) Date of Patent: May 22, 2012

(54) SHOWER TRAY

(75) Inventor: Mark Ian Luxton, Onchan (GB)

(73) Assignee: DLP Limited, Isle of Man (GB)

( * ) Notice: Subject to any disclaimer, the term of this patent is extended or adjusted under 35 U.S.C. 154(b) by 1185 days.

(21) Appl. No.: 11/911,694

(22) PCT Filed: Sep. 20, 2005

(86) PCT No.: PCT/GB2005/003625

§ 371 (c)(1),
(2), (4) Date: Oct. 16, 2007

(87) PCT Pub. No.: WO2006/123082

PCT Pub. Date: Nov. 23, 2006

(65) Prior Publication Data

US 2009/0139022 A1 Jun. 4, 2009

(30) Foreign Application Priority Data

May 20, 2005 (GB) ..... 0510321.3

(51) Int. Cl.
*A47K 3/22* (2006.01)
*A47K 3/36* (2006.01)
*A47K 3/34* (2006.01)

(52) U.S. Cl. ..... 4/613

(58) Field of Classification Search ..... 4/612, 613
See application file for complete search history.

(56) References Cited

U.S. PATENT DOCUMENTS 2,757,385 A * 8/1956 Whittick ..... 4/613
4,541,132 A * 9/1985 Long ..... 4/614
4,777,675 A * 10/1988 Letner ..... 4/599
4,975,992 A * 12/1990 Patterson et al. ..... 4/599
5,140,789 A 8/1992 De Gooyer
5,718,008 A * 2/1998 Pane ..... 4/613
6,647,565 B2 11/2003 Smale
6,941,703 B2 * 9/2005 MacLean et al. ..... 52/34

FOREIGN PATENT DOCUMENTS

DE 20201845 U1 5/2002
GB 2 270 836 A 3/1994

OTHER PUBLICATIONS

Search Report for Great Britain priority application No. GB0510321.3 dated Aug. 22, 2005. International Search Report published Nov. 23, 2006 for PCT/GB2005/003625 filed Sep. 20, 2005.
International Preliminary Report on Patentability published Nov. 23, 2007 for PCT/GB2005/003625 filed Sep. 20, 2005.
Written Opinion of the International Searching Authority published Nov. 20, 2007 for PCT/GB2005/003625 filed Sep. 20, 2005.

* cited by examiner

*Primary Examiner* — Dinh Nguyen
(74) *Attorney, Agent, or Firm* — Fleit Gibbons Gutman Bongini & Bianco, PL; Paul D. Bianco; Martin Fleit

(57) ABSTRACT

A shower tray (10) comprising a trimmable edge (26) for trimming a dimension of the tray to fit a given area, a waste water gully (28) which extends from the trimmable edge (26) and which includes a gully fall (32) in a direction away from the trimmable edge (26), and a waste water surface (30) which extends with the gully (28) from the trimmable edge (26). The waste water surface (30) has a waste water surface fall (34) which is parallel or substantially parallel to the trimmable edge (26) and which leads into the gully (28). As a result of the waste water surface fall (34) and the gully fall (32), a two stage water runoff arrangement is provided.

6 Claims, 11 Drawing Sheets

SHOWER TRAY

FIELD OF THE INVENTION

The present invention relates to a shower tray which is suitable for trimming to fit a given area and, in particular, but not exclusively, to a shower tray which is suitable for trimming to length and/or width.

BACKGROUND OF THE INVENTION

It is known to provide so-called trim-to-length shower trays. Contour Showers Limited of Cheshire, United Kingdom provide one such shower tray. A trim-to-length shower tray allows the installer to remove part, or all, of one end portion of the shower tray to enable fitting in a predetermined area.

A problem with this type of known shower tray is that the trimmable portion is flat or formed with a only a very shallow fall. As a consequence, drainage of waste water from the trimmable portion is poor.

A shower tray having a trimmable portion with a steeper fall has not been utilised, due to the necessity of securing a 'one size fits all' end cap to the trimmed edge. The top edge of the end cap must align with the top edge of the remaining part of the shower tray, in order to provide a neat and finished appearance. However, the end cap must also liquid-tightly seal against the trimmed edge of the shower tray to prevent leakage. Therefore, providing a very shallow fall, or no fall at all, maintains a constant or substantially constant profile and gives a reasonably good end cap fit.

SUMMARY OF THE INVENTION

The present invention seeks to provide a trimmable shower tray with excellent drainage while utilising a single or universal end cap.

According to the present invention, there is provided a shower tray suitable for trimming to fit, the shower tray comprising a trimmable edge, a waste water gully which extends from the trimmable edge and which includes a gully fall in a direction away from the trimmable edge, and a waste water surface which extends with the gully from the trimmable edge and which has a waste water surface fall parallel or substantially parallel to the trimmable edge and leading into the gully.

Preferable and/or optional features of the invention are set forth in claims 2 to 9, inclusive.

BRIEF DESCRIPTION OF THE DRAWINGS

The invention will now be more particularly described, by way of example with reference to the accompanying drawings, in which.

DETAILED DESCRIPTION OF THE INVENTION

Figure 1:
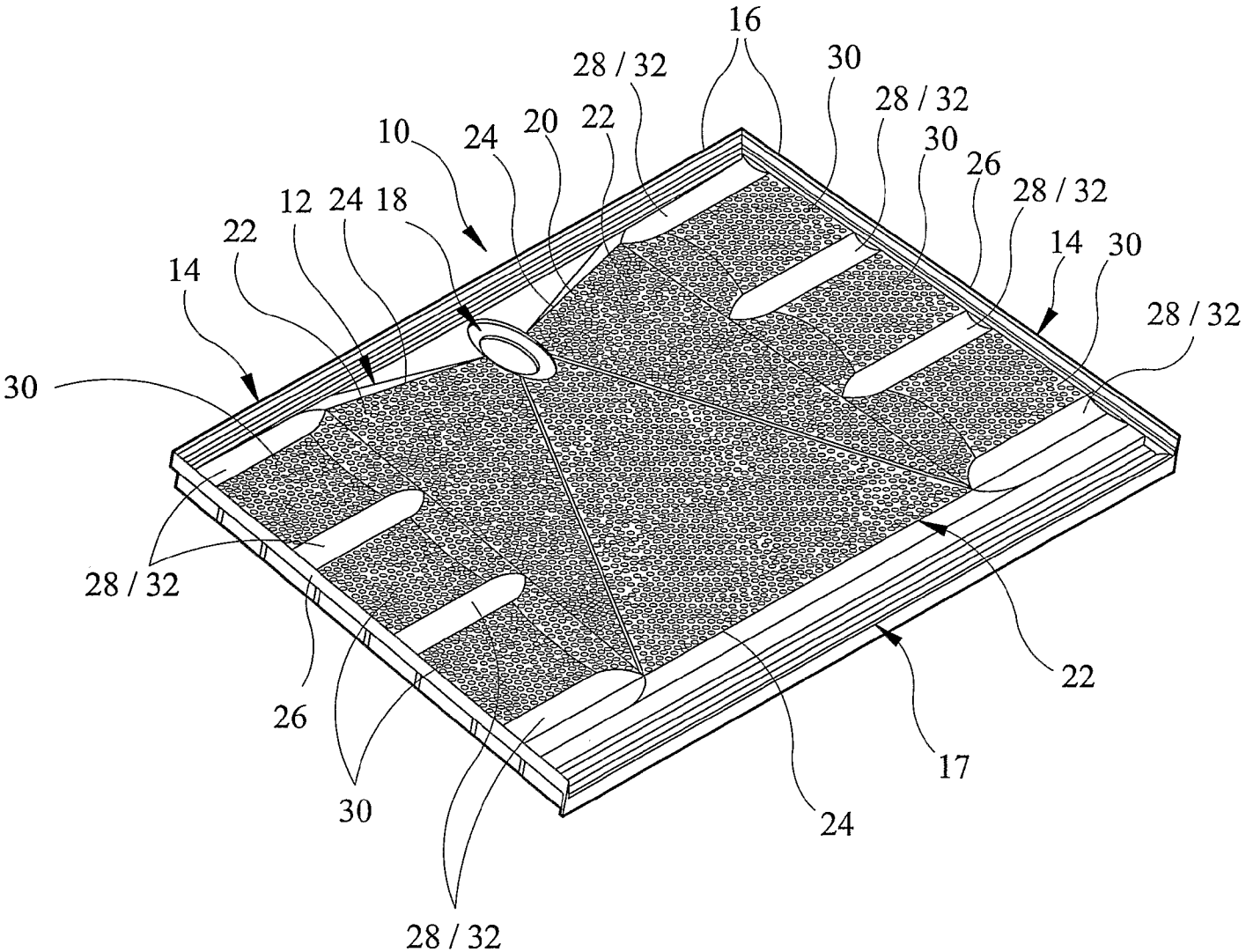
FIG. 1 is a perspective view of one embodiment of a shower tray, in accordance with the present invention.
Figure 2:
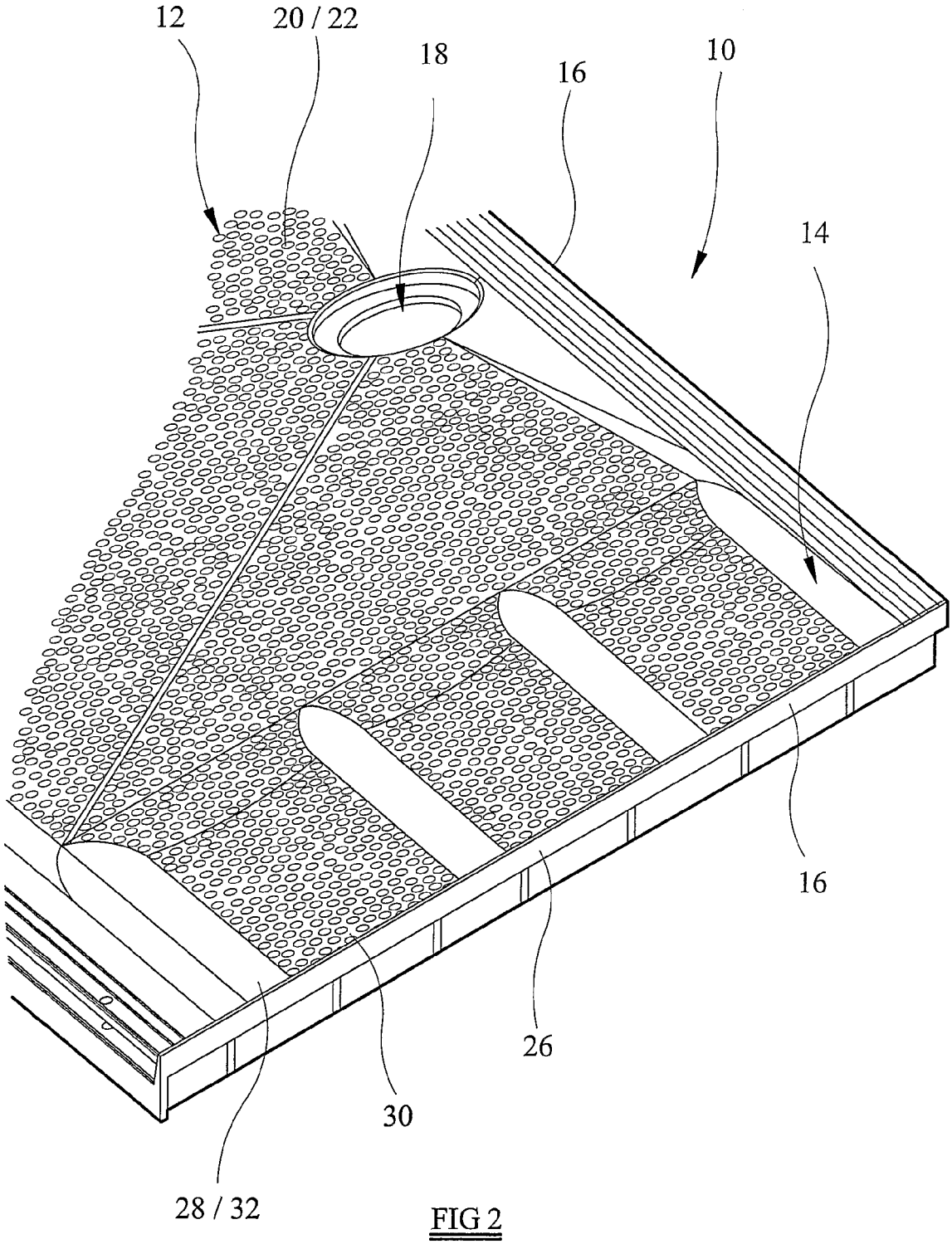
FIG. 2 is an enlarged scrap view of one end of the shower tray shown in FIG. 1.

Referring to the drawings, there is shown a rectangular, typically GRP moulded, shower tray 10 which comprises a central waste water outlet portion 12 and a trimmable portion 14 either side of the waste water outlet portion 12. A raised edge or lip 16 to reduce splashing extends around three sides of the shower tray 10. An access 17 is provided along the fourth side.

The waste water outlet portion 12 has a waste water outlet opening 18 for connection to a drain, and a waste water outlet surface 20 which has a fall 22 leading to the waste water outlet opening 18. In this case, the waste water outlet surface 20 includes three contiguous facets or surface portions 24 which converge towards the waste water outlet opening 18. However, less than or more than three contiguous facets can be provided. The waste water outlet surface 20 can even be dished.

The waste water outlet opening 18 can also be provided at any position on the waste water outlet portion 12.

Each trimmable portion 14 includes a trimmable edge 26, a plurality of waste water gullies 28, and a waste water surface 30. Each gully 28 extends perpendicularly or substantially perpendicularly from the trimmable edge 26 and tapers to a point on the waste water outlet portion 12 due to the fall 22 of the waste water outlet surface 20. Each gully 28 includes a gully fall 32 in a direction away from the trimmable edge 26 and towards the waste water outlet portion 12.

Figure 7A:
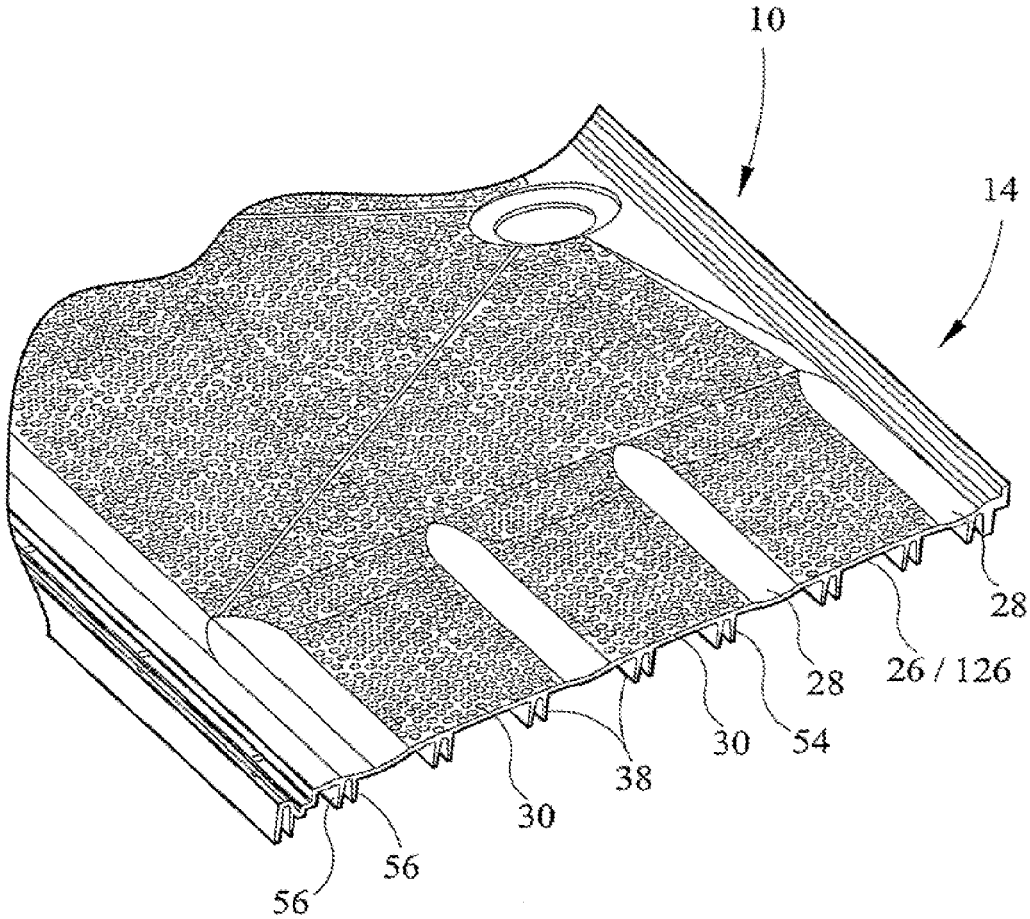
FIG. 7*a* is a scrap view of the shower tray from above, showing the trimmable edge.
Figure 7B:
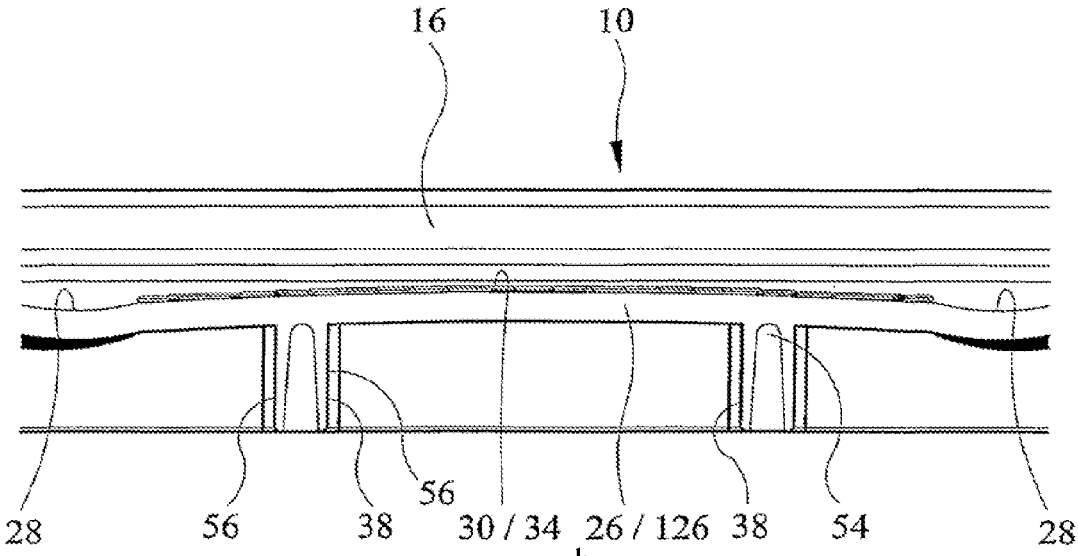
FIG. 7*b* is an end view of the shower tray shown in FIG. 7*a*, showing the trimmable edge.

The waste water surface 30 of the trimmable portion 14 is interposed between the gullies 28 and extends with the gullies 28 from the trimmable edge 26. The waste water surface 30 between the gullies 28 is convex (best seen in FIG. 7*b*) in a direction parallel to the trimmable edge 26. This provides a fall 34 which leads into adjacent gullies 28.

The waste water surface 30 has no fall in the direction of the waste water outlet surface 20. Consequently, the waste water surface 30 extends perpendicularly from the trimmable edge 26. As a result, a fall only exists for water to runoff from the waste water surface 30 into the gullies 28 in a direction parallel or substantially to the trimmable edge 26. Once waste water enters the gullies 28, it is carried to the waste water outlet portion 12 of the shower tray 10 by the fall 32 of the gullies 28. Once discharged from the gullies 28, the waste water runs to the waste water outlet opening 18.

This two stage water runoff arrangement, in other words, firstly running parallel to the trimmable edge 26 from the waste water surface 30 into the gullies 28, and then running perpendicularly away from the trimmable edge 26 along the gullies 28, is particularly advantageous for reasons which will become apparent hereinafter.

Figure 5:
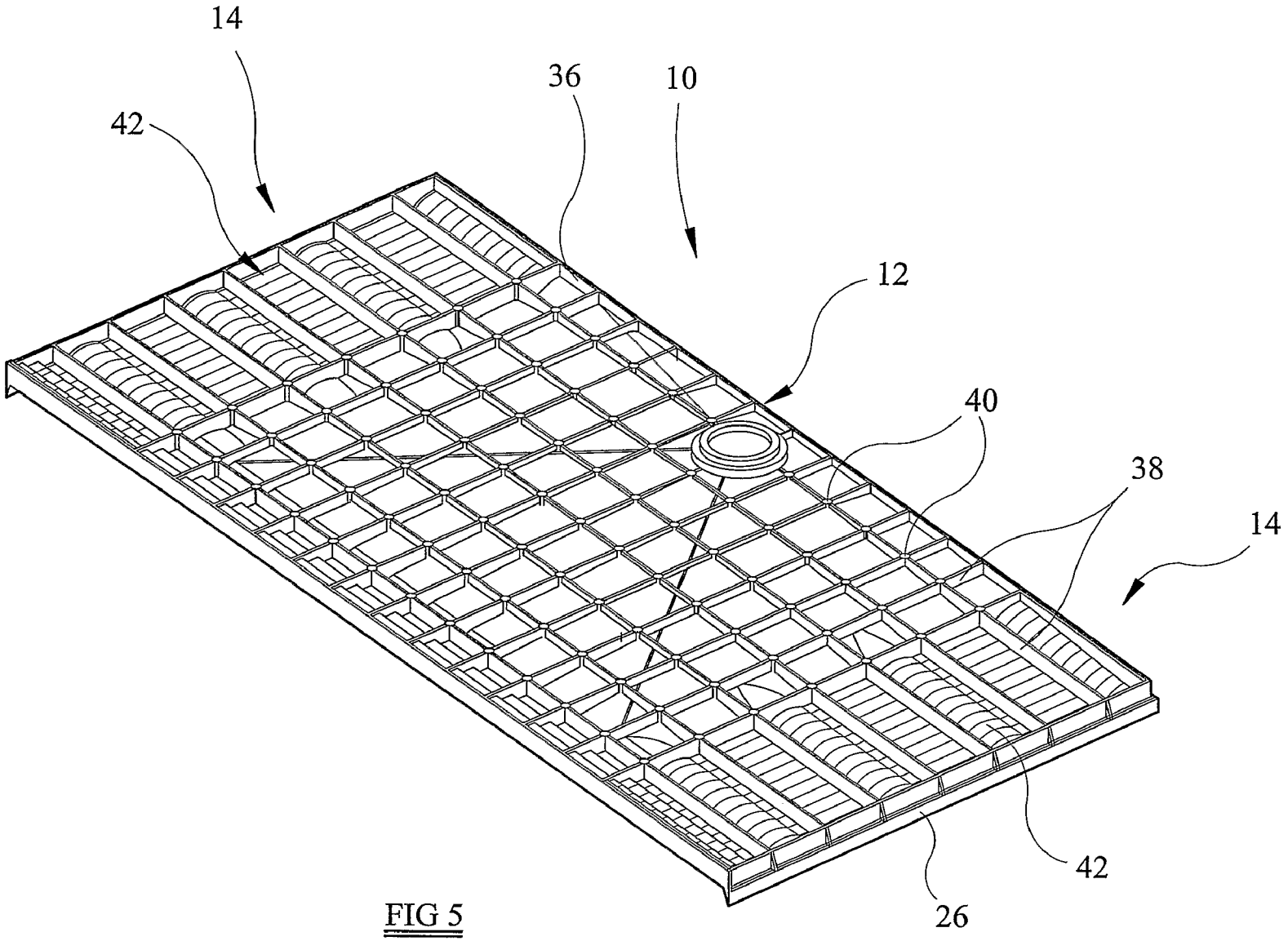
FIG. 5 is a perspective view of the shower tray from below.
Figure 6:
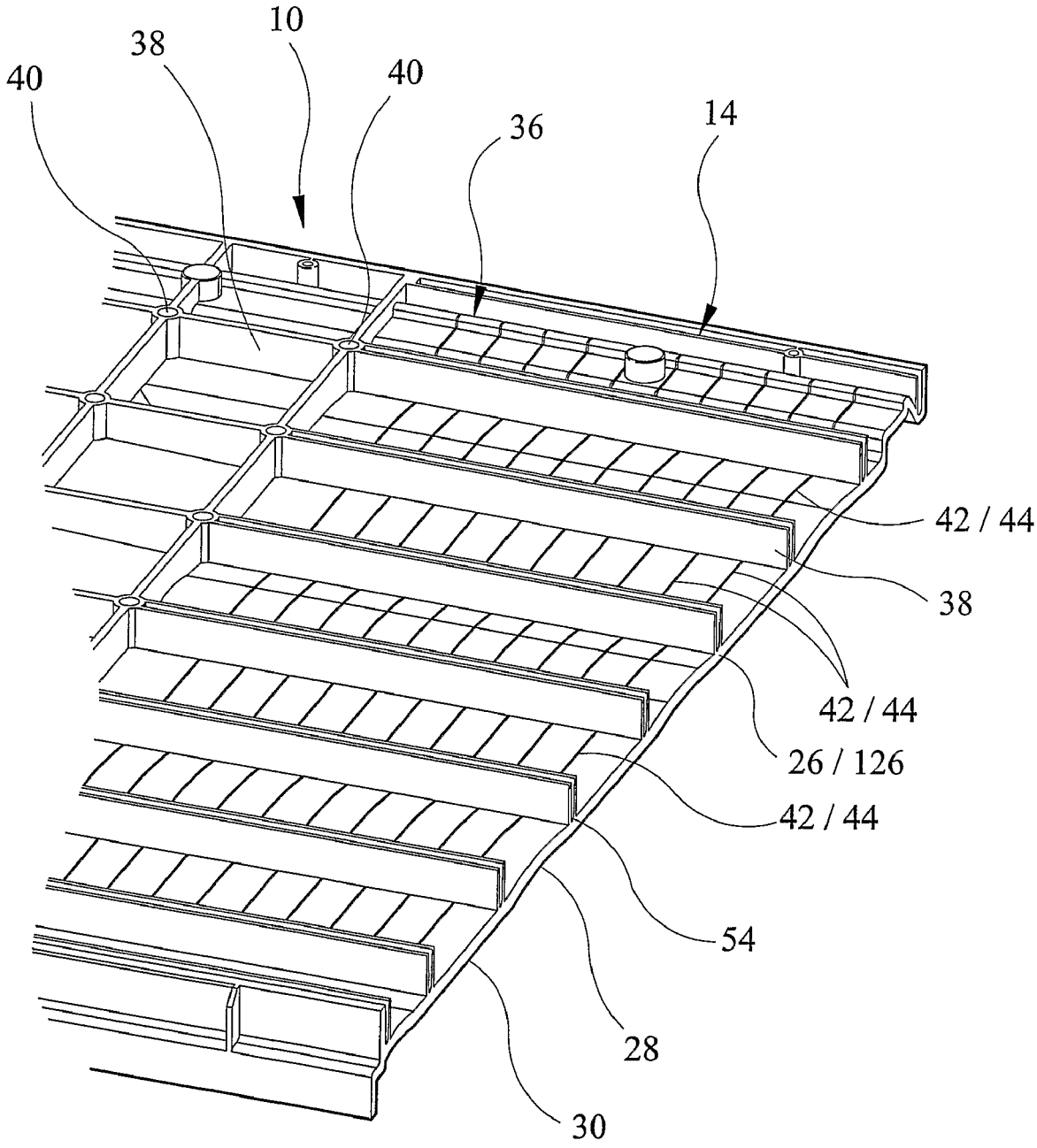
FIG. 6 is a scrap view of the shower tray from below, showing a trimmable edge and cutting guide.

The underside 36 of the shower tray 10 is provided with reinforcing ribs 38 and load bearing bosses 40, as best seen in FIGS. 5 and 6. Cutting guides 42 for the trimmable portions 14 are provided on the underside 36 between the ribs 38.

Distance measurements from the trimmable edges 26 are stamped as guide markings 44 to simplify the determination of a cutting point and to maintain a parallel cut.

Once the required overall length of the shower tray 10 has been determined, material is removed from the or each trimmable portion 14 until the trimmable edges 26 are positioned to correspond to the required dimension of the shower tray 10. By utilising the cutting guide 42, a new trimmable edge 126 is formed which is parallel or substantially parallel with the original trimmable edge 26.

Figure 8:
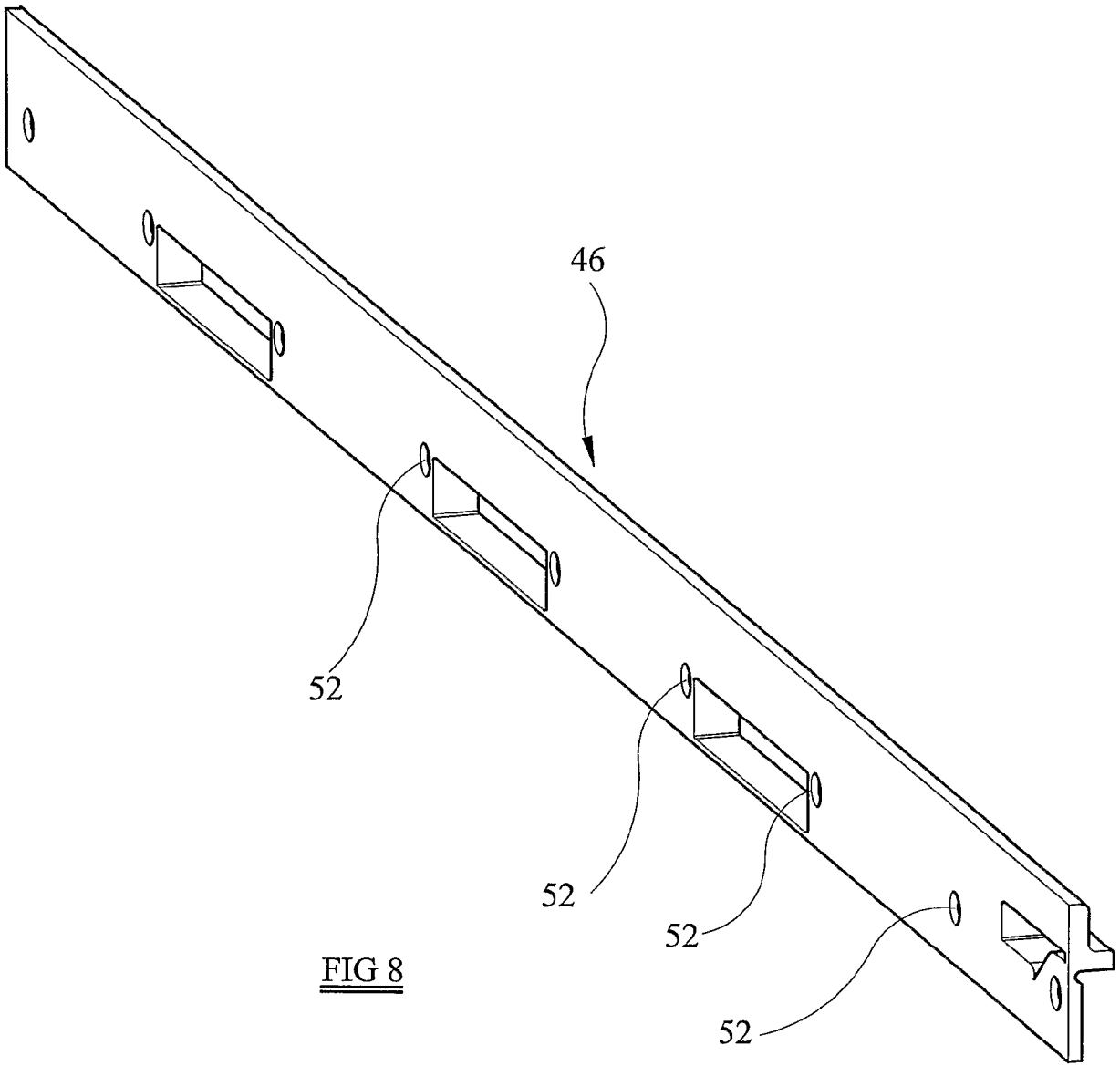
FIG. 8 is a perspective view of one side of an end cap of the shower tray.
Figure 9:
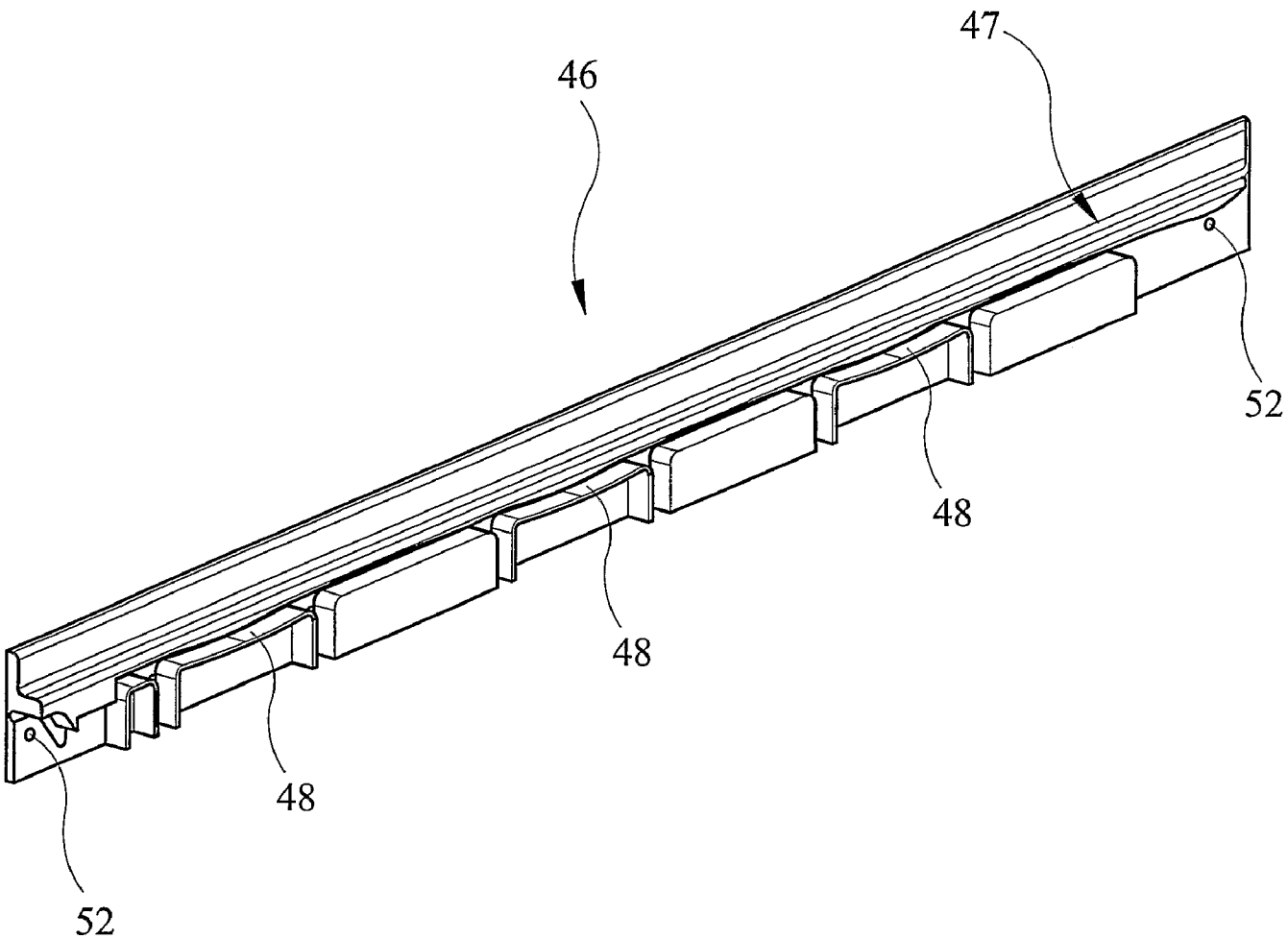
FIG. 9 is a perspective view of the other side of the end cap.

With the shower tray 10 trimmed to length, an end cap 46, as shown in FIGS. 8 and 9, is used to re-form the original lip 16 cutaway when removing the original trimmable edge 26. One side 47 of the end cap 46 is complementarily shaped to receive the trimmable edge 126 of the shower tray 10. Since the waste water surface 30 of the trimmable portion 14 has a constant or substantially constant fall 34 into each gully 28 and no fall perpendicular to the trimmable edge 26/126, the end cap 46 can achieve a tight or tolerance mating fit with the waste water surface 30.

Figure 3:
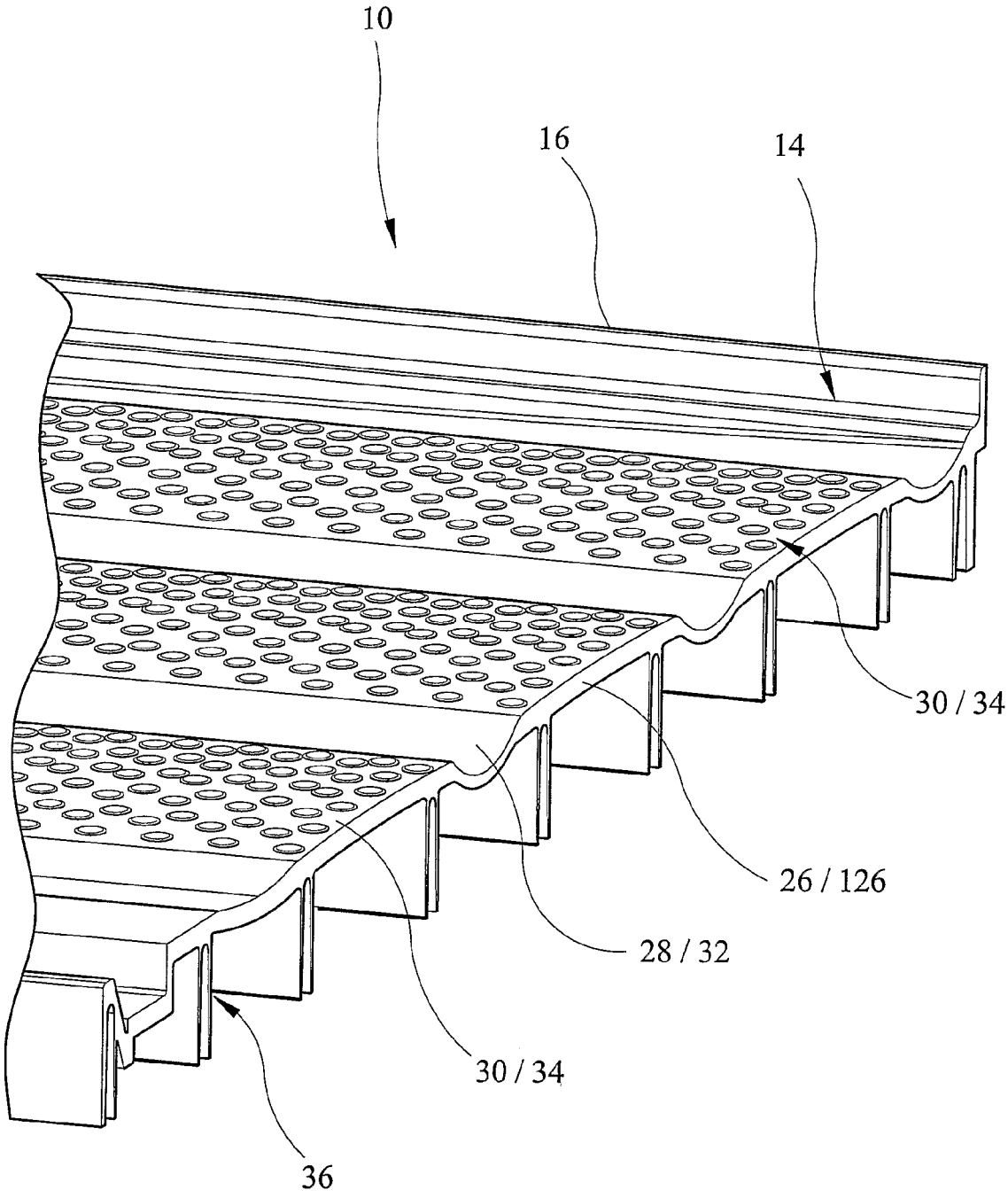
FIG. 3 is a perspective view, similar to FIG. 3, showing a trimmable edge of the shower tray with a first amount of the shower tray removed.
Figure 4:
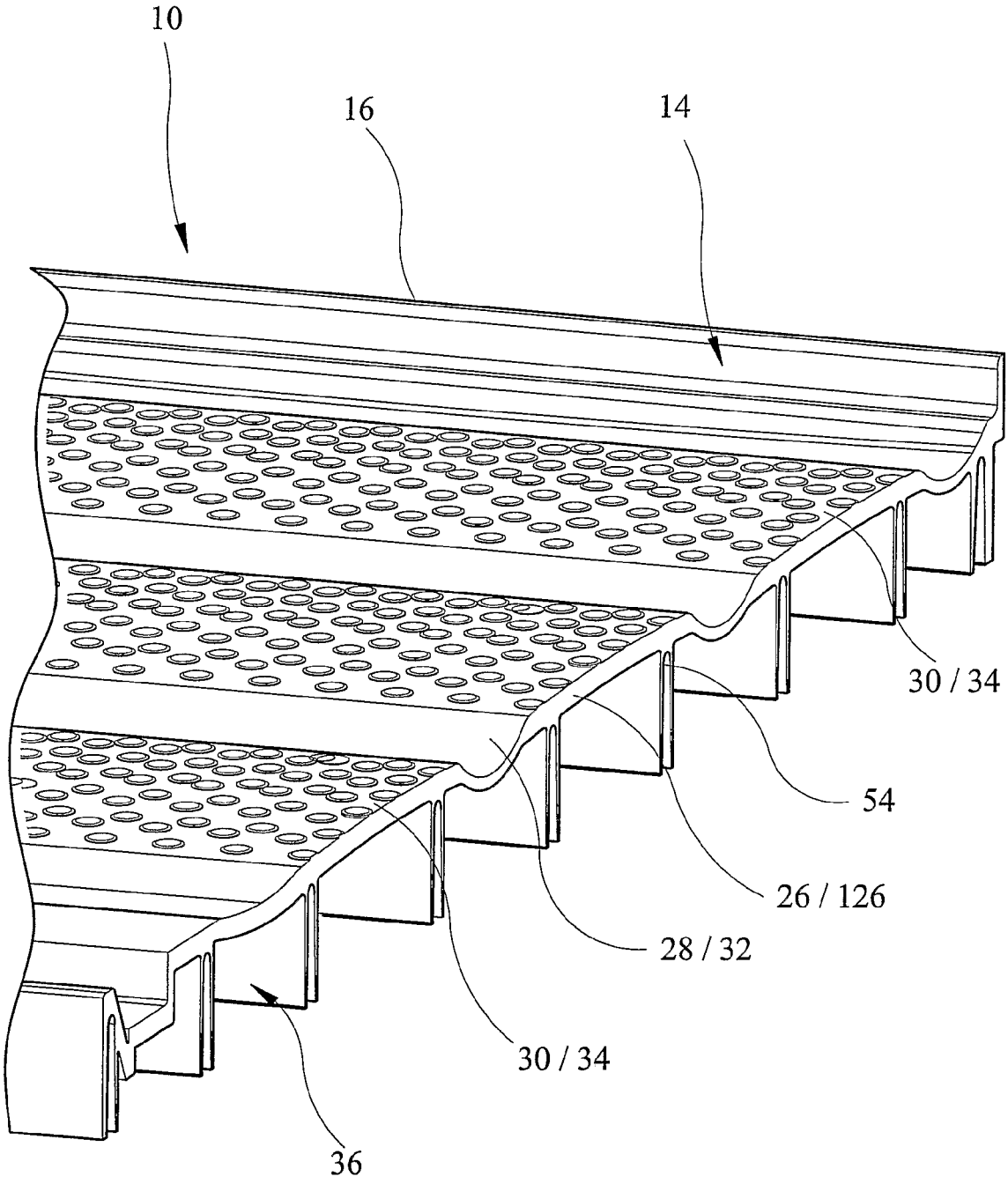
FIG. 4 is a slightly enlarged perspective view of the shower tray, showing the trimmable edge but with a second greater amount of the tray removed.

Each gully 28 does include a fall 32 towards the waste water outlet portion 12 and thus, as can be seen in FIGS. 3 and 4, the gully 28 gradually deepens as the waste water outlet portion 12 is approached. As such, the end cap 46 includes a flexible moulding 48 which flexes to accommodate the profile of the gullies 28 along the trimmable edge 26.

To fix the end cap 46 to the trimmable edge 126 of the shower tray 10, screw threaded fasteners 50 and/or adhesive is utilised. In the case of screw threaded fasteners 50, holes 52 are provided in the lower part of the end cap 46, and the reinforcing ribs 38 on the underside 36 of the shower tray 10 are provided with screw ports 54 for receiving the threaded end of the fasteners 50. This is conveniently accomplished by forming each rib 38 with a two prong transverse section, with each screw port 54 being formed by the positioning of adjacent prongs 56.

To liquid-tightly seal the end cap 46 to the trimmable edge 26, sealant is first applied to the end cap 46 and/or the trimmable edge 126 prior to the end cap 46 being secured in place.

Figure 10:
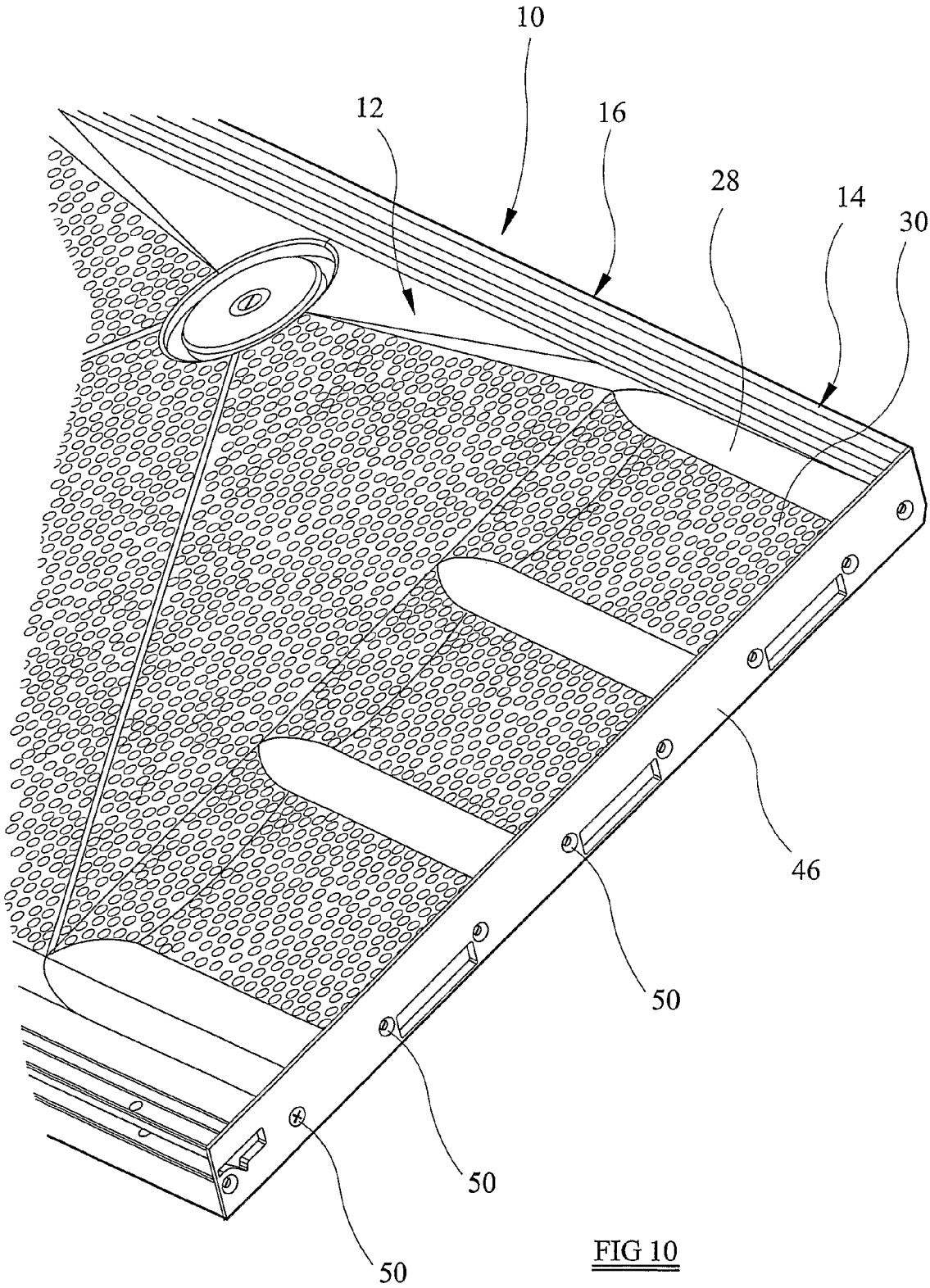
FIG. 10 is a scrap perspective view from above of the trimmable edge of the shower tray with end cap attached.
Figure 11:
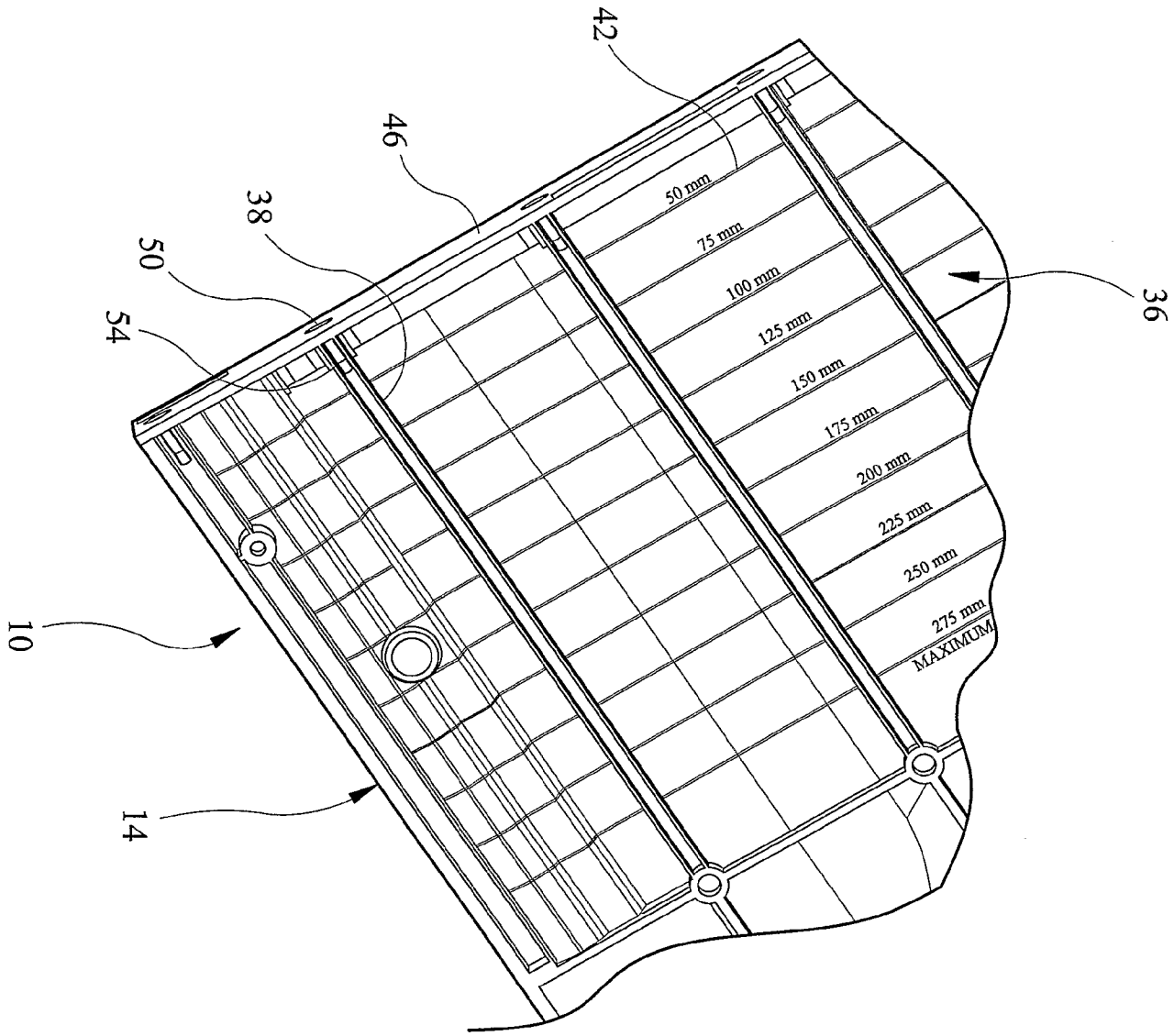
FIG. 11 is a scrap perspective view from below of the trimmable edge of the shower tray with end cap attached.

As can be seen in FIGS. 10 and 11, by providing a trimmable portion 14 with a two stage fall for water runoff, a shower tray 10 having a large selectable length and excellent drainage is produced. Furthermore, a single or universal end cap 46 can be provided which not only aligns with the top edge of the surrounding lip 16 of the shower tray 10, but which also closely fits the profile of the trimmable edge 126 regardless of the amount of material removed from the trimmable portion 14.

The integral cutting guide 42 enables quick and parallel removal of material from the trimmable portion 14, and the unitary screw ports 54 allow simplified fastening of the end cap 46 to the trimmable edge 126.

Although the trimmable edges of the shower tray shown extend along the width dimension, the trimmable edges could alternatively, or additionally, extend along the length dimension to enable the width of the shower tray to be adjustable.

A single trimmable portion, or more than two trimmable portions, can be provided.

The shower tray can be any non-circular shape. It is also envisaged that the shower tray could be circular, with the trimmable portion extending inwardly from the circumference, which thus defines the trimmable edge.

A plurality of gullies are provided. However, each trimmable portion could have only a single gully.

It is thus possible to provide a trimmable shower tray which has great utility while maintaining effective draining. It is also possible to provide a single or universal end cap which aligns accurately with the top edge of the shower tray and which can be utilised at any trimmed position.

The embodiments described above are given by way of examples only, and other modifications will be apparent to persons skilled in the art without departing from the scope of the invention as defined by the appended claims.

The invention claimed is:

1. A shower tray suitable for trimming to fit, the shower tray comprising:

a trimmable portion including a trimmable edge;

a waste water outlet portion including a waste water outlet surface and a waste water outlet opening for connection to a drain and formed in the waste water outlet surface;

a waste water gully which extends perpendicularly or substantially perpendicularly from the trimmable edge and which includes a gully fall in a direction away from the trimmable edge; and a waste water surface which extends with the gully from the trimmable edge and which has a waste water surface fall parallel or substantially parallel to the trimmable edge and leading into the gully;

the waste water gully having a fall leading to the waste water outlet surface, and the waste water surface having no or substantially no fall from the trimmable edge to the waste water outlet surface.

2. The shower tray of claim 1, wherein the fall of said waste water surface is constant or substantially constant.

3. The shower tray of claim 1, further comprising an end cap which can be liquid-tightly secured to said trimmable edge once said trimmable edge is cut.

4. The shower tray of claim 1, further comprising a cutting guide with guide markings running parallel to said trimmable edge.

5. The shower tray of claim 1, further comprising at least one additional trimmable edge, said waste water gully extending from each of said trimmable edges.

6. The shower tray according to claim 1, further comprising at least one additional water gully and wherein a plurality of said waste water gullies are provided in spaced relationship, said or each waste water surface being interposed between said gullies.

* * * * *